US008997300B2

(12) United States Patent
Huang

(10) Patent No.: US 8,997,300 B2
(45) Date of Patent: Apr. 7, 2015

(54) CUSHIONING TOOTHBRUSH

(71) Applicant: Acumen Co., Ltd., New Taipei (TW)

(72) Inventor: Shou-Jen Huang, New Taipei (TW)

(73) Assignee: Acumen Co., Ltd., New Taipei (TW)

( * ) Notice: Subject to any disclaimer, the term of this patent is extended or adjusted under 35 U.S.C. 154(b) by 6 days.

(21) Appl. No.: 13/909,488

(22) Filed: Jun. 4, 2013

(65) Prior Publication Data

US 2014/0352092 A1 Dec. 4, 2014

(51) Int. Cl.
*A46B 7/06* (2006.01)
*A46B 9/04* (2006.01)

(52) U.S. Cl.
CPC ..... *A46B 9/04* (2013.01)

(58) Field of Classification Search
USPC ..... 15/167.1, 172, 201
See application file for complete search history.

(56) References Cited

U.S. PATENT DOCUMENTS

| | | | | |
|---|---|---|---|---|
| 2,706,825 | A * | 4/1955 | Blakeman | 15/176.4 |
| 7,614,111 | B2 * | 11/2009 | Moskovich et al. | 15/167.1 |
| 8,099,819 | B2 * | 1/2012 | Kraemer | 15/167.1 |
| 8,590,095 | B2 * | 11/2013 | Crossman | 15/167.1 |

* cited by examiner

*Primary Examiner* — Mark Spisich
(74) *Attorney, Agent, or Firm* — C. G. Mersereau; Nikolai & Mersereau, P.A.

(57) ABSTRACT

Provided is a toothbrush having a handle, a tuft block, multiple lateral cushioning gels and a rear cushioning gel. The handle has a head and a fore linking member protruding from the head. The tuft block has a fore end linked to the fore linking member. A gap is formed between the head and the tuft block. Multiple bristle tufts are planted on the tuft block. The multiple lateral cushioning gels connect the head and the tuft block. The rear cushioning gel connects a rear end of the tuft block and the handle.

11 Claims, 3 Drawing Sheets

CUSHIONING TOOTHBRUSH

BACKGROUND OF THE INVENTION

1. Field of the Invention

The present invention relates to a toothbrush, especially to a toothbrush with a head capable of slight swaying to match the surfaces of teeth.

2. Description of the Prior Art

Tooth brushing eliminates food residues and dental plaques and stimulates the gums so as to facilitate circulation and strengthen pathogen-resisting abilities of tissues. A toothbrush is an indispensable instrument for tooth brushing. A well-designed toothbrush provides significant oral hygiene effects.

Teeth are solid objects whose surfaces are not flat, while the tufted bristles of a toothbrush head are also solid in Watts of abutting against the teeth, even though individual filaments of the bristles are resilient. As a result, the bristle tufts, which are not able to perfectly match the surfaces of teeth, inevitably leave certain unreachable dead angle and fail to furbish all the surfaces of the teeth. The failure of a conventional toothbrush to eliminate dead angles and to extensively cleanse the teeth compels a user to unconsciously force the bristles of the tufts against the teeth. When the bristles driven by such an unnecessarily strong force reach the gums, the tips of the bristles hurt and damage the gums.

To overcome the shortcomings, the present invention provides a cushioning toothbrush to mitigate or obviate the aforementioned problems.

SUMMARY OF THE INVENTION

The main objective of the invention is to provide a cushioning toothbrush that absorbs the unnecessarily strong driving force applied to the toothbrush.

The toothbrush in accordance with the present invention has a handle, a tuft block, multiple lateral cushioning gels and a rear cushioning gel.

The handle has a head formed at an end of the handle and a fore linking member protruding from the head.

The tuft block is positioned correspondingly to a side of the handle and has a fore end linked to the fore linking member. A gap is formed between the head and the tuft block. Multiple bristle tufts are planted on the tuft block.

Each of the multiple lateral cushioning gels has an attaching end and a gripping end. The attaching ends of the multiple lateral cushioning gels are respectively connected to lateral regions of the head. The gripping ends of the multiple lateral cushioning gels are respectively connected to flanking portions of the tuft block.

The rear cushioning gel has a first end connected to a rear end of the tuft block and a second end connected to a region of the handle adjacent to the second end of the rear cushioning gel.

Preferably, the head of the handle comprises multiple ribs aligned at intervals, wherein each of the ribs extends perpendicularly along a longitudinal direction of the handle and comprises two first mounting members respectively defined at two ends of the rib. The tuft block comprises multiple second mounting members correspondingly defined at intervals respectively on the flanking portions of the tuft block. The attaching ends of the multiple lateral cushioning gels are respectively connected to the first mounting members while the gripping ends of the multiple lateral cushioning gels are connected to the second mounting members.

Preferably, each of the second mounting members is a recess.

Preferably, the tuft block comprises a third mounting member defined at the rear end of the tuft block. The handle comprises a fourth mounting member defined through a region of the handle readily neighboring to the third mounting member. The first end of the rear cushioning gel is connected to the third mounting member, and the second end of the rear cushioning gel is connected to the fourth mounting member.

Preferably, the third mounting member is a recess and the fourth mounting member is a through hole for injecting a gel material.

Preferably, the head of the handle comprises a receiving sheath formed on an outer surface of the head. The fourth mounting member, which is a through hole, is defined through a furrowed surface of the receiving sheath. A sheathing gel is held in the receiving sheath and fused with the multiple lateral cushioning gels and the rear cushioning gel.

Preferably, each of the multiple lateral cushioning gels comprises an undulate outer surface.

The only solid connection of the tuft block to the handle is at the fore end of the tuft block via the fore linking member of the head, while the multiple lateral cushioning gels and the rear cushioning gel are resilient gels. With the aforementioned structures, when a user holds the handle to brush teeth and the bristle tufts contact a surface of a tooth to be furbished, the tuft block sways to match the surface of the tooth, which allows tips of the bristles to move on and along the contacted surface. In addition, the multiple lateral cushioning gels and the rear cushioning gel further absorb overly strong force unconsciously applied by the user, which prevents the gums from damage while providing improved hygiene and enhanced furbishing effects.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
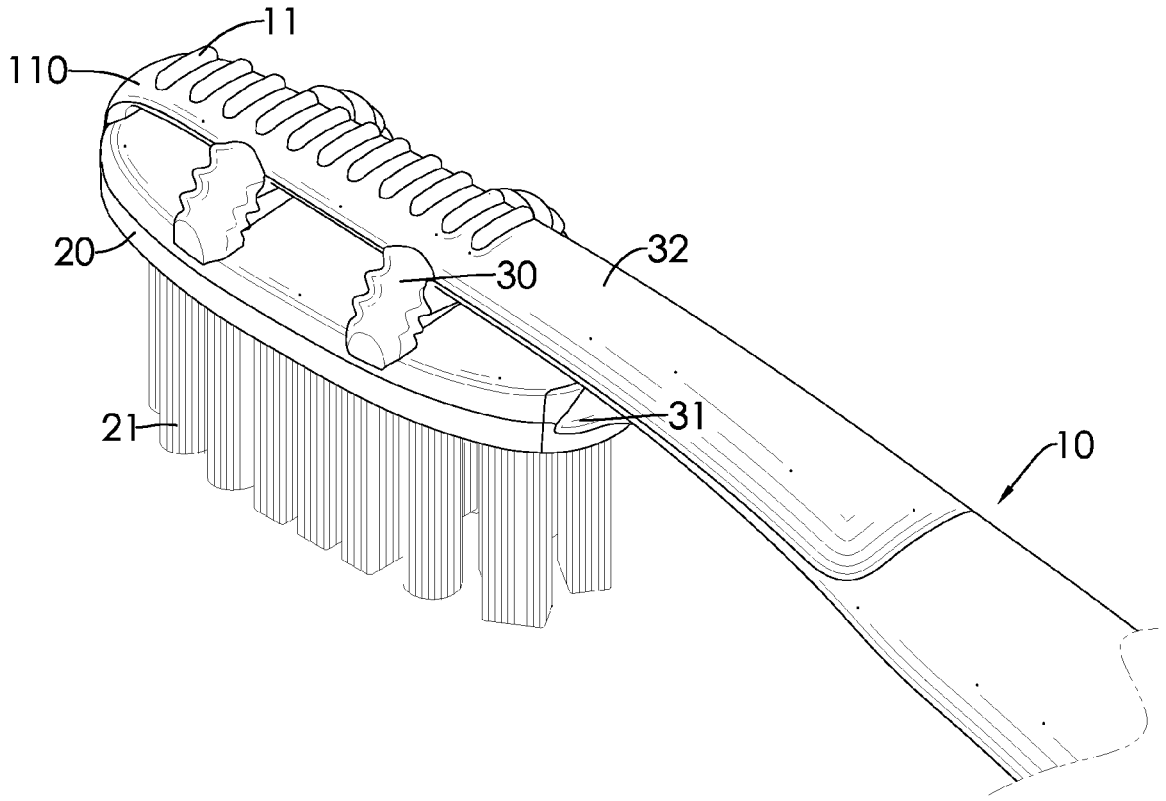
FIG. 1 is a perspective view of a cushioning toothbrush in accordance with the present invention.

With reference to FIG. 1, an embodiment of the toothbrush in accordance with the present invention has a handle 10, a tuft block 20, four lateral cushioning gels 30 and a rear cushioning gel 31.

Figure 2:
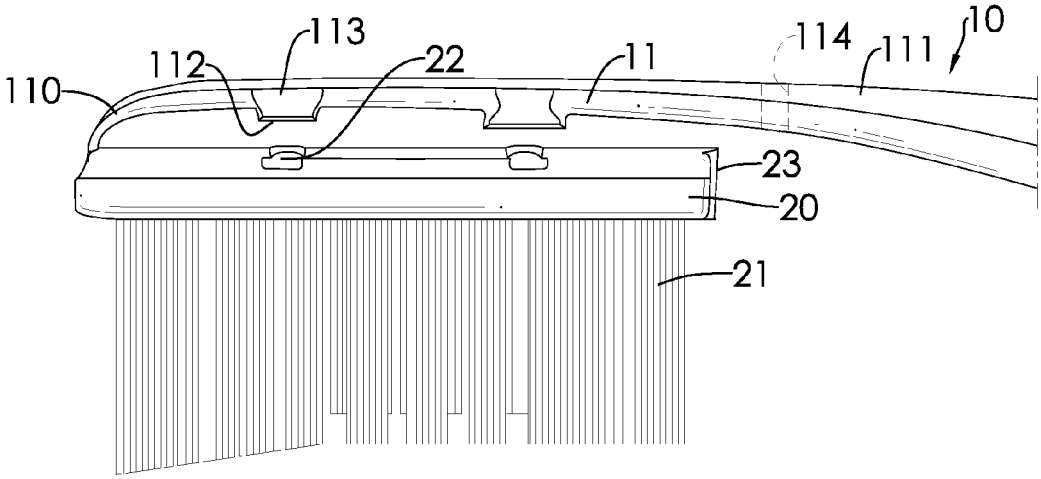
FIG. 2 is a partial side view of the handle and the tuft block of the cushioning toothbrush in FIG. 1.
Figure 3:
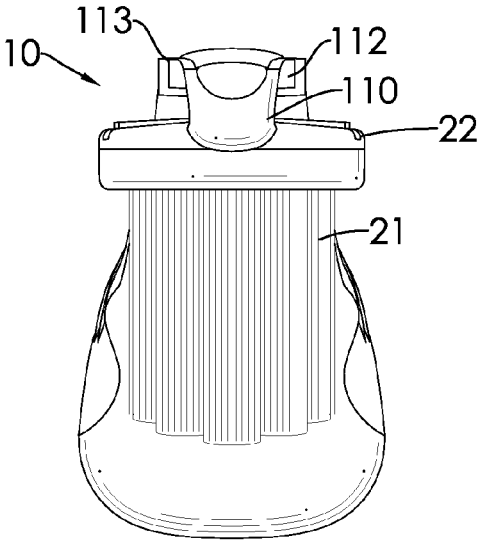
FIG. 3 is a partial front view of the handle and the tuft block of the cushioning toothbrush in FIG. 1.

With reference to FIGS. 1 to 3, wherein in FIGS. 2 and 3 only the handle 10 and the tuft block 20 are shown, the handle 10 comprises a head 11 formed at an end of the handle 10 and a fore linking member 110 protruding from a front rim portion of the head 11. The fore linking member 110 is a thin plate. The head 11 comprises a receiving sheath 111 formed on an outer surface of the head 11. The receiving sheath 111 extends along a longitudinal direction of the head 11. The head 11 of the handle 10 comprises two ribs 112 aligned at intervals on an inner surface of the head 11, wherein each of the ribs 112 extends perpendicularly along the longitudinal direction of the head. Each of the ribs 112 comprises two ends and two first mounting members 113. The two ends of the rib are respectively positioned on lateral regions of the head 11. The two first mounting members 113 are respectively defined at the two ends of the rib 112. The head 11 of the handle 10 comprises a fourth mounting member 114 being a through hole formed through a furrowed surface of the receiving sheath 111 and communicating with the receiving sheath 111.

The tuft block 20 is oval and flat and comprises multiple tuft holes (not shown in figures) and multiple bristle tufts 21 planted respectively in the tuft holes. The tuft block 20 extends along a longitudinal direction of the handle 10. The tuft block 20 is positioned correspondingly to a side of the head 11. A gap is formed between the head 11 and the tuft block 20. The tuft block 20 comprises a fore end. The fore end of the tuft block 20 is aligned on a longitudinal axis of the tuft block 20 and is linked to the fore linking member 110. In a preferred embodiment of the present invention, the handle 10, the fore linking member 110 and the tuft block 20 are formed integrated by injection molding. The tuft block 20 comprises two flanking portions and four second mounting members 22. Two of the four second mounting members 22 are separately positioned in one of the two flanking portions of the tuft block 20, while the other two second mounting members 22 are separately positioned in the other flanking portion of the tuft block 20. Each of the second mounting members is a recess recessed in a surface of the tuft block 20. The second mounting members 22 are respectively close to the first mounting members 113 with a distance between the second mounting member and the first mounting member. The tuft block 20 further comprises a rear end and a third mounting member 23. The third mounting member 23 is a recess recessed in a surface of the tuft block 20. The third mounting member 23 is neighboring to the fourth mounting member 114 with a distance between each other.

Figure 4:
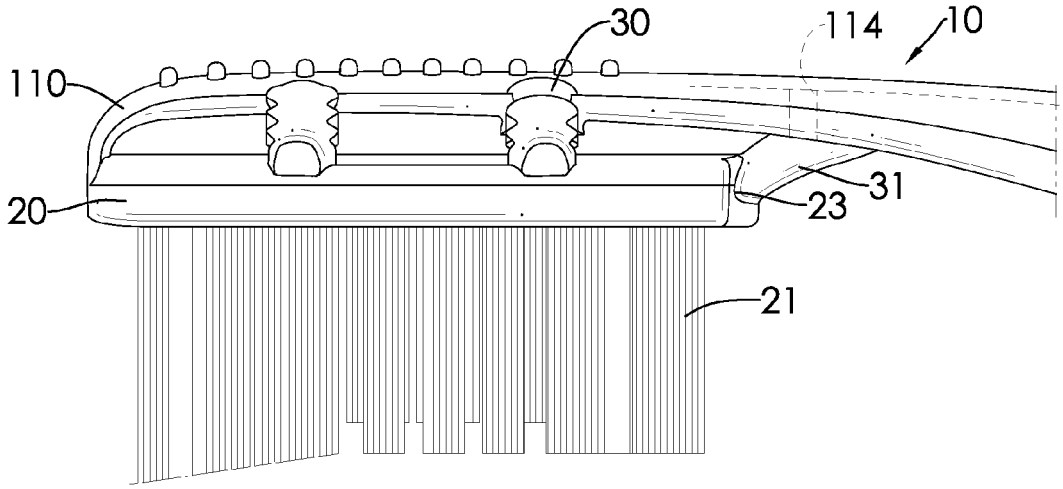
FIG. 4 is a partial side view of the cushioning toothbrush in FIG. 1.
Figure 5:
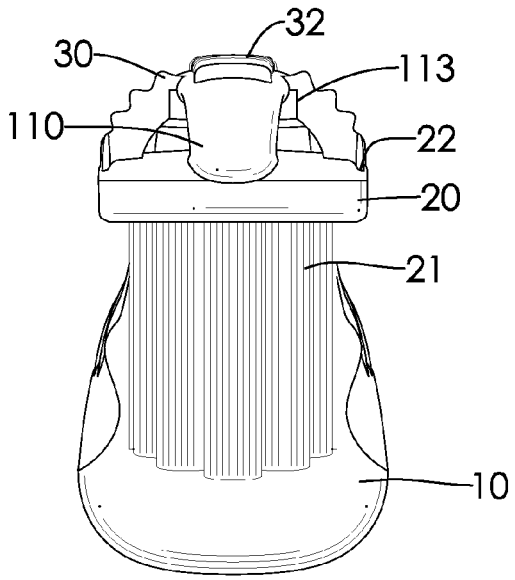
FIG. 5 is a partial front view of the cushioning toothbrush in FIG. 1.

With reference to FIGS. 1, 4 and 5, each of the multiple lateral cushioning gels 30 is a resilient gel and comprises an undulate outer surface. Two lateral cushioning gels 30 are positioned in one of the two lateral regions of the handle 10 and the other two lateral cushioning gels 30 are positioned in the other lateral region of the handle 10. Each of the multiple lateral cushioning gels 30 comprises an attaching end and a gripping end. The attaching ends of the multiple lateral cushioning gels 30 are respectively connected to the first mounting members 113 of the lateral regions of the head 11 of the handle 10, while the gripping ends of the multiple lateral cushioning gels 30 are respectively connected to the second mounting members 22 of the flanking portions of the tuft block 20.

The rear cushioning gel 31 is a resilient gel and comprises a first end connected to the third mounting member 23 of the tuft block 20 and a second end connected to the fourth mounting member 114 of the handle 10. Preferably, the first end of the rear cushioning gel 31 is inserted in the third mounting member 23, which is a recess. The second end of the rear cushioning gel 31 is inserted in the fourth mounting member 114, which is a through hole. In a preferred embodiment of the present invention, a sheath gel 32 is fused with the multiple lateral cushioning gels 30 and the rear cushioning gel 31. The sheath gel 32 is formed on the handle 10 within the receiving sheath 111 by means of a secondary injection molding.

With the aforementioned features, when a user holds the cushioning toothbrush in accordance with the present invention to brush teeth, the bristle tufts 21 of the tuft block 20 remove food debris and dental plaques from surfaces of the teeth. By abutting and moving against the surface of the teeth, tips of the bristle tufts 21 generate a reaction force back to the tuft block 20. With the foregoing structure comprising the tuft block 20, the unique solid connection formed between the tuft block 20 and the head 11 via the fore linking member 110, as well as the multiple lateral cushioning gels 30 and the rear cushioning gel 31 that form resilient connections between the tuft block 20 and the head 11, the tuft block 20 is driven by the aforementioned reaction force to press against the resilient multiple lateral cushioning gels 30 and the rear cushioning gel 31, so that the tuft block 20 slightly bends and sways around the fore linking member 110 to match the surfaces of teeth. The bending and swaying motions of the tuft block 20 permit movements on and along the surfaces of teeth and improve dental hygiene, while the multiple lateral cushioning gels 30 and the rear cushioning gel 31 absorb the force overly and unconsciously applied by a user and prevent the gums from damages, thereby achieving enhanced cleansing effects and oral health maintenance.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A toothbrush comprising:

a handle comprising:

a head formed at an end of the handle; and a fore linking member protruding from the head;

a tuft block positioned correspondingly to a side of the handle and comprising:

a fore end linked to the fore linking member and forming a gap between the head and the tuft block; and multiple bristle tufts planted on the tuft block;

multiple lateral cushioning gels each comprising:

an attaching end; and a gripping end, wherein the attaching ends are respectively connected to lateral regions of the head and the gripping ends are connected to flanking portions of the tuft block; and a rear cushioning gel comprising:

a first end connected to a rear end of the tuft block; and a second end connected to a region of the handle adjacent to the second end of the rear cushioning gel.

2. The toothbrush as claimed in claim 1, wherein the head of the handle comprises multiple ribs aligned at intervals, wherein each of the ribs extends perpendicularly along a longitudinal direction of the handle and comprises:

two ends; and two first mounting members respectively defined at the two ends of the rib;

the tuft block comprises:

multiple second mounting members correspondingly defined at intervals respectively on the flanking portions of the tuft block;

the attaching ends of the multiple lateral cushioning gels are respectively connected to the first mounting members; and the gripping ends of the multiple lateral cushioning gels are respectively connected to the second mounting members.

3. The toothbrush as claimed in claim 2, wherein each of the second mounting members is a recess.

4. The toothbrush as claimed in claim 3, wherein the tuft block comprises:

a third mounting member defined at the rear end of the tuft block;

the handle comprises:

a fourth mounting member defined through a region of the handle readily neighboring to the third mounting member;

the first end of the rear cushioning gel is connected to the third mounting member; and the second end of the rear cushioning gel is connected to the fourth mounting member.

5. The toothbrush as claimed in claim 4, wherein the third mounting member is a recess; and the fourth mounting member is a through hole for injecting a gel material.

6. The toothbrush as claimed in claim 5, wherein the head of the handle comprises:

a receiving sheath foil lied on an outer surface of the head;

a furrowed surface; and a sheathing gel held in the receiving sheath and fused with the multiple lateral cushioning gels and the rear cushioning gel; and the fourth mounting member is defined through the furrowed surface.

7. The toothbrush as claimed in claim 6, wherein each of the multiple lateral cushioning gels comprises an undulate outer surface.

8. The toothbrush as claimed in claim 2, wherein the tuft block comprises:

a third mounting member defined at the rear end of the tuft block;

the handle comprises:

a fourth mounting member defined through a region of the handle readily neighboring to the third mounting member;

the first end of the rear cushioning gel is connected to the third mounting member; and the second end of the rear cushioning gel is connected to the fourth mounting member.

9. The toothbrush as claimed in claim 8, wherein the third mounting member is a recess; and the fourth mounting member is a through hole for injecting a gel material.

10. The toothbrush as claimed in claim 9, wherein the head of the handle comprises:

a receiving sheath formed on an outer surface of the head;

a furrowed surface; and a sheathing gel held in the receiving sheath and fused with the multiple lateral cushioning gels and the rear cushioning gel; and the fourth mounting member is defined through the furrowed surface.

11. The toothbrush as claimed in claim 10, wherein each of the multiple lateral cushioning gels comprises an undulate outer surface.

* * * * *